United States Patent [19]

Venditti et al.

[11] Patent Number: 4,798,016

[45] Date of Patent: Jan. 17, 1989

[54] PICTURE PEN

[76] Inventors: Arthur P. Venditti, 2 Seneca Rd., Peabody, Mass. 01960; William M. Martz, R.R. 2, Box 153A, West Point, Iowa 52656

[21] Appl. No.: 848,029

[22] Filed: Apr. 3, 1986

[51] Int. Cl.[4] ..... G09F 3/00

[52] U.S. Cl. ..... 40/334; 40/660; 40/905

[58] Field of Search ..... 40/334, 19, 306, 905, 40/310, 311, 309, 335; 24/11 R

[56] References Cited

U.S. PATENT DOCUMENTS

| | | | |
|---|---|---|---|
| 475,400 | 5/1892 | Houghton et al. | 40/19 |
| 1,049,275 | 12/1912 | Scott | 40/334 |
| 2,677,901 | 5/1954 | Tilleman | 40/19 |
| 3,154,873 | 11/1964 | Shea | 40/334 |
| 3,191,329 | 6/1965 | Shea | 40/334 |
| 3,341,962 | 9/1967 | Siegel | 40/334 |
| 3,764,064 | 10/1973 | Gaidos et al. | 40/334 |
| 4,018,536 | 4/1977 | Brenner | 40/334 |
| 4,207,695 | 6/1980 | Penza, Jr. | 40/334 |
| 4,336,882 | 6/1982 | Sakwa | 40/334 |
| 4,365,390 | 12/1982 | Kageyama et al. | 24/11 R |
| 4,381,615 | 5/1983 | Lonsmin | 40/334 |

FOREIGN PATENT DOCUMENTS

| | | | |
|---|---|---|---|
| 354344 | 8/1931 | United Kingdom | 40/334 |

*Primary Examiner*—Gene Mancene
*Assistant Examiner*—Cary E. Stone
*Attorney, Agent, or Firm*—Joseph S. Iandiorio; Brian M. Dingman

[57] ABSTRACT

An assembly for removably accommodating an image medium including a generally cylindrical element and a transparent sleeve removably disposable over the cylindrical element. The transparent sleeve has an opening at one end for receiving the element and has an inner diameter slightly larger than the outer diameter of the element for defining a chamber to accommodate the image medium. There is also a device for removably securing the sleeve with the cylindrical element.

20 Claims, 3 Drawing Sheets

PICTURE PEN

FIELD OF INVENTION

This invention relates to a picture-bearing assembly for a cylindrical article and more particularly to such an assembly which facilitates easy removal and installation of different pictures in a pen.

BACKGROUND OF INVENTION

There are a number of devices in the prior art which display a picture or other image in addition to performing functions specific to the device. U.S. Pat. No. 3,374,911 discloses a plastic cosmetic jar assembly which tightly and permanently confines a picture between an insert plastic liner and an outer transparent shell. That patent teaches structure which seals in the picture to prevent contact with the contents of the jar. The elimination of air space between the shell and the liner is desired to provide a substantially solid walled jar. The picture, once installed, cannot be removed unless the liner is forcibly separated from the shell in a manner not contemplated by that patent.

Different types of display mechanisms have been provided for other containers. U.S. Pat. No. 2,844,893 describes a container which is surrounded by an outer label-retaining member which permits a label to be changed at will without disassociating the member from the container. The label-retaining member contains a slot through which the label is inserted and removed.

In another device, described in U.S. Pat. No. 3,338,458, an inner sleeve and an outer sleeve themselves serve as an ornamental cover for a vial such as a lipstick container. Portions of the inner sleeve are exposed above and below the outer sleeve to provide a color contrast between the two sleeves. The bore of the outer sleeve and the outer surface of the inner sleeve are mounted to have a very tight friction fit and may be further secured by cementing or heat-sealing them together. In another construction, the outer sleeve is transparent and indicia is printed on one or both of the sleeves.

Many inventions are directed to the placement of display elements on pens. U.S. Pat. No. 1,655,365 describes a picture frame with a hinged cover which is placed on the outer surface of a pen cap. A fixed frame is provided in U.S. Pat. No. 1,712,501 which allows an image to be inserted from the side of the frame laterally into the space between the frame and the article on which the frame is mounted.

Yet other inventions are directed to the display of images which are specially manufactured for the article in which the images are displayed. U.S. Pat. Nos. 3,077,691; 3,077,692; 3,250,033; 3,191,329; and 3,341,962 are representative of these inventions. The images borne by these pens are selected and installed during manufacture of the pens. Most of the images are intended to serve advertising purposes. The images are not intended to be removed and exchanged; indeed, the images are often permanently affixed within the pen.

SUMMARY OF INVENTION

It is therefore an object of this invention to provide an improved picture-bearing assembly.

It is a further object of this invention to provide such an assembly which allows the picture to be easily inserted and removed.

It is a further object of this invention to provide such an assembly which completely encloses the picture within the assembly.

A still further object of this invention is to provide such an assembly which does not require a picture frame for displaying the picture.

Yet another object of this invention is to provide such an assembly in a pen that accommodates personal photographs and other relatively large images provided by the owner of the pen.

The invention results from the realization that a truly effective device for displaying personal photographs can be achieved by providing for a cylindrical article a mechanism which removably secures an outer transparent sleeve over the cylindrical article.

This invention features an assembly for removably accommodating an image medium. There are a generally cylindrical element and a transparent sleeve removably disposable over the cylindrical element. The transparent sleeve has an opening at a first end for receiving the element and has an inner diameter slightly larger than the outer diameter of the element for defining a chamber to accommodate the image medium. There is also means for removably securing the sleeve with the cylindrical element.

In one embodiment, the means for removably securing includes means for frictionally engaging the cylindrical element and the transparent sleeve relative to each other. The means for frictionally engaging may be disposed on the cylindrical element to engage the transparent sleeve proximate the first and when the sleeve is disposed over the cylindrical element. The means for frictionally engaging may include a ring of friction material such as a vinyl compound.

Alternatively, the means for removably securing includes means for fixing the sleeve with the cylindrical element. The means for fixing is disposed proximate a second end of the sleeve and includes shaft means and means for releasably receiving the shaft means. The shaft means may be extendable through a hole in the means for receiving and may include at least one dog proximate the end of the shaft that is extendable through the hole. The hole is shaped so that in at least one orientation it admits the dog. The means for receiving may include a camming surface and the dog interacts with the camming surface to forcibly engage the transparent sleeve against the cylindrical element. The camming surface may include a land for the dog with a slope on one side of the land and a stop on the other side. The shaft means may include a knurled grip on its end opposite the end extendable through the hole in the means for receiving. The transparent sleeve may include a ring, disposed proximate the second end, for engaging the cylindrical element, and the means for receiving may be mounted within the cylindrical element.

In a preferred embodiment, the assembly further includes guide means for axially positioning the transparent sleeve and the cylindrical element relative to each other when the transparent sleeve is disposed over the element. The guide means is disposed on the transparent sleeve proximate the second end of the sleeve and may include a ring which contacts the cylindrical element. Alternatively, the guide means includes collar means disposed on the cylindrical element for arresting axial movement of the sleeve. The collar means may arrest the first end of the transparent sleeve.

The assembly may further include means for engaging the transparent sleeve with the cylindrical element to inhibit rotation of the sleeve relative to the element. The means for engaging may include a detent on one of the cylindrical element and the transparent sleeve and at least one recess on the other for receiving the detent. The assembly may further include a template representing dimensions of the chamber and alignment means for laterally positioning the sleeve and the element relative to each other when the sleeve is disposed over the element. In one embodiment, the alignment means includes a chamfered protrusion on an end of one of the cylindrical element and the transparent sleeve and a recess on an end of the other for mating with the protrusion.

The cylindrical element may be a cap for receiving a pen. The transparent sleeve can include a pen clip mount which slidably receives an end of the pen clip.

This invention may also be expressed as an assembly for removably accommodating an image medium in a pen, including a generally cylindrical pen element and a transparent sleeve. The assembly further includes guide means for axially positioning the transparent sleeve and the pen element relative to each other when the transparent sleeve is disposed over the pen element and means for removably securing the sleeve with the pen element.

This invention also features an assembly for removably accommodating an image medium in a pen including a pen element, a transparent sleeve, and means for engaging the transparent sleeve with the pen element to inhibit rotation of the sleeve relative to the pen element. There is also means for removably securing the sleeve with the pen element.

DISCLOSURE OF PREFERRED EMBODIMENT

Other objects, features and advantages will occur from the following description of a preferred embodiment and the accompanying drawings, in which.

This invention may be accomplished by a generally cylindrical element and a transparent sleeve removably disposable over the cylindrical element to define a chamber which accommodates an image medium. The assembly includes a device for removably securing the sleeve with the cylindrical element. The device for removably securing may frictionally engage the cylindrical element and the transparent sleeve relative to each other or may fix the sleeve with the cylindrical element using a mechanism such as an inclined cam member and a shaft carrying one or more dogs. Preferably, the sleeve is mechanically aligned axially and laterally relative to the cylindrical element.

Figure 1:
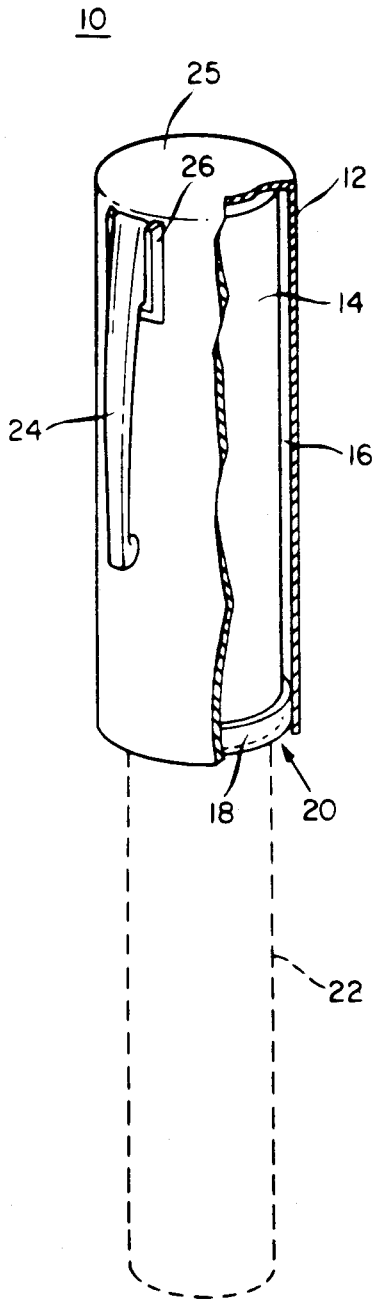
FIG. 1 is an axonometric, partial cutaway view of a pen cap assembly according to this invention.

In one construction, the cylindrical element is a pen element, e.g., a pen cap such as shown in FIG. 1. Cap assembly 10 includes transparent sleeve 12 disposed over pen cap 14 to define chamber 16 for displaying an image medium. Friction ring 18 is a vinyl plastic compound which engages the portion of sleeve 12 proximate opening 20 in sleeve 12. Friction ring 18 also defines the lower boundary of chamber 16. A writing implement such as pen 22, shown in phantom, is received by cap 14.

Figure 2:
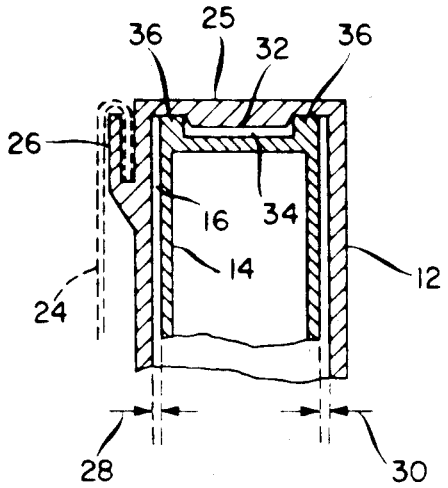
FIG. 2 is a cross-sectional view of the upper portion of the pen cap assembly of FIG. 1 revealing novel pen clip attachment and lateral alignment of the transparent sleeve.

Pen cap assembly 10 also includes clip 24, which is carried near end plate 25 by mount 26. Mount 26 is shown in greater detail in FIG. 2, which reveals that clip 24 is secured without encroaching upon chamber 16.

To decrease rubbing and other wear on an image medium disposed in chamber 16, it is desirable for the depth of the chamber to remain relatively constant on either side of cap 14 during use, i.e., for the depth represented by dimension arrows 28 to remain similar to the depth represented by dimension arrows 30. The lateral position or centering of sleeve 12 relative to cap 14 is maintained by protrusion 32 from end plate 25 which mates with recess 34 in cap 14. Protrusion 32 has chamfered edges which engage projections 36 of cap 14 such that it becomes seated in cap 14 to laterally position sleeve 12.

Figure 3:
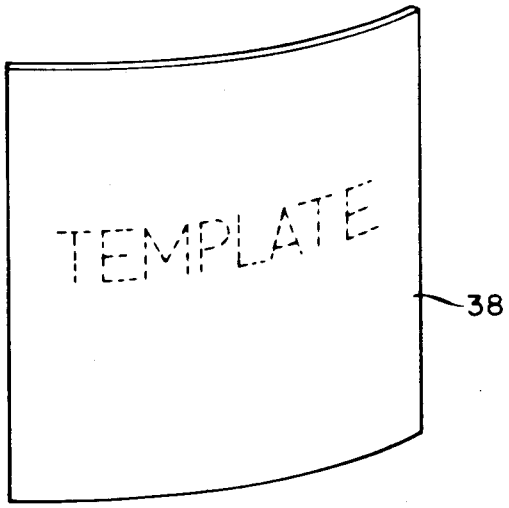
FIG. 3 is an axonometric view of a template for an image to be removably carried by the pen cap assembly of FIG. 1.

An example of a template for an image medium which is accommodated by pen cap assembly 10 is shown in FIG. 3. The image medium can be a photograph, a drawing, a poem, reference chart, souvenir or other personal item. Template 38 can be carried by cap assembly 10, FIG. 1, and represents the maximum length and height which will be accommodated by the chamber of the pen cap assembly.

When the transparent sleeve is an acetate tube having a standard $\frac{5}{8}$ inch O.D., template 38 has a dimension of approximately $1\frac{3}{4}$ inch length and a height of $2$–$2\frac{1}{4}$ inch. If desired, template 38 can also represent the depth of the chamber.

Figure 4:
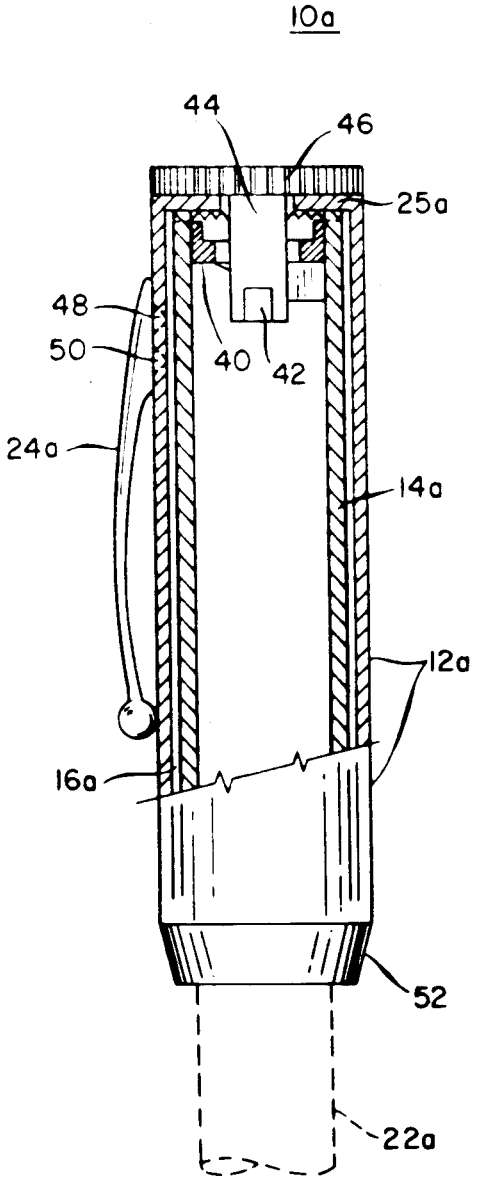
FIG. 4 is an elevational, partial cutaway view of another pen cap assembly according to this invention.

Other securing devices which do not frictionally engage the sleeve and the cap may be used. One construction is shown in FIG. 4 for pen cap assembly **10*a*. Pen cap assembly 10*a* is shown in partial cross section to reveal cam member 40 which engages dog 42 of shaft 44 as described below. Shaft 44 includes knurled grip 46**.

FIG. 4 also reveals that clip **24*a* is mounted to sleeve 12*a* by teeth 48, 50, which are embedded in sleeve 12*a*. In an alternative construction, teeth 48, 50 project through sleeve 12*a* and are peened to lie flat against the inner surface of sleeve 12*a***.

Transparent sleeve **12*a* is axially positioned relative to cap 14*a* by collar 52 which is integral with cap 14*a*. Axial positioning is also maintained by end plate 25*a* which is in the form of a ring having an opening to admit shaft 44. Lateral positioning of sleeve 12*a* can be accomplished by a collar on shaft 44*a*, such as collar 54, shown in phantom in FIG. 5, which snugly engages the opening in end plate 25*a***.

Figure 5:
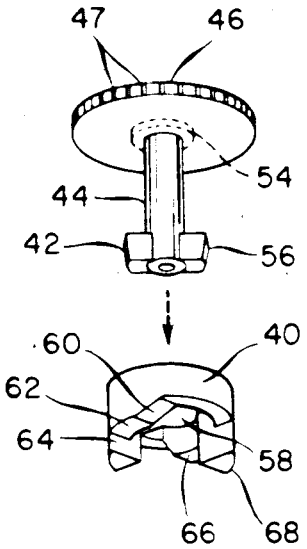
FIG. 5 is an enlarged, exploded, axonometric view of the shaft and inclined cam member of FIG. 4.

Shaft 44 can include dogs 42, 56, FIG. 5, which pass through opening 58 in cam member 40. Once dogs 42, 56 have been inserted through opening 58, grip 46 having splines 47 is rotated to the left to slide dog 56 across slope 60 to come to rest on land 62 against stop 64. Similarly, dog 42 comes to rest on land 66 against stop 68. When pen assembly **10*a* is assembled, it is desirable that dogs 42, 56 cam against lands 62, 66 to forcibly engage the transparent sleeve against the cylindrical element such that cap 14a, sleeve 12a, and grip 46** not have any play among them.

Figure 6:
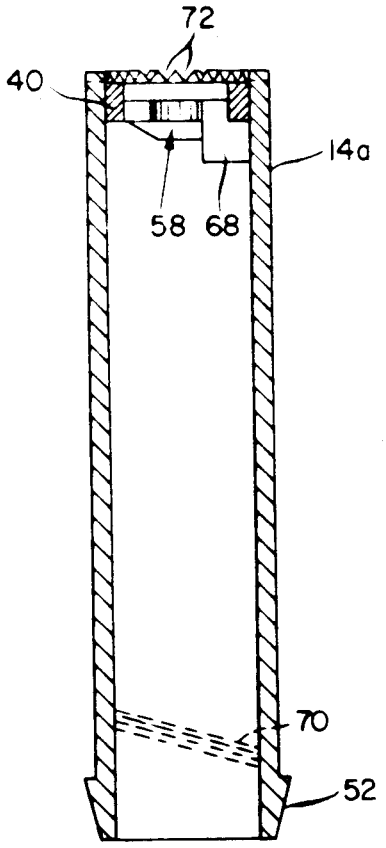
FIG. 6 is a cross-sectional view of the cap of FIG. 4.

Another view of hole 58 and stop 68 of camming member 40 is provided in FIG. 6. Also shown is collar 52 and threads 70, shown in phantom, for engaging pen 22a, FIG. 4.

Figure 7:
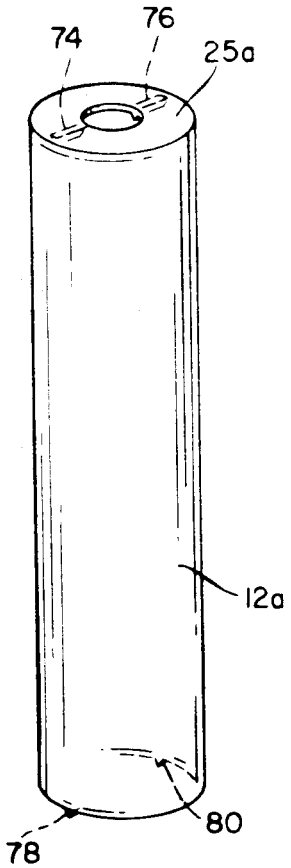
FIG. 7 is an axonometric view of the transparent sleeve of FIG. 4.

In addition to controlling axial and lateral movement of transparent sleeve 12a relative to cap 14a, cap assembly 10a controls the rotation of these two elements relative to each other as shown in FIGS. 6 and 7. Recesses 72 receive detents 74, 76 on sleeve 12a proximate end plate 25a. Alternatively, sleeve 12a can include detents 78, 80, which are received by recesses in collar 52. By comparison, pen cap assembly 10, FIG. 1, relies on frictional engagement to inhibit rotation.

While the assembly for removably accommodating images is described above in terms of a pen cap assembly, this is not a limitation of the invention. Other cylindrical elements, such as lipstick containers and the like, can be provided with a transparent sleeve and a device for removably securing the sleeve to the element in accordance with the invention. Not only does every magazine or printed piece become a potential source of art for display, but any sort of cylindrical element becomes a potential display assembly.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An assembly for removably accommodating an image medium, comprising:

a generally cylindrical element;

a transparent sleeve removably disposable over said cylindrical element having an opening at a first end for receiving said element, and having an inner diameter slightly larger than the outer diameter of said element for defining a chamber to accommodate the image medium; and means for removably securing said sleeve with said cylindrical element including means for frictionally engaging said cylindrical element and said transparent sleeve relative to each other, said means for frictionally engaging being disposed on said cylindrical element to engage said transparent sleeve proximate said first end when said sleeve is disposed over said cylindrical element.

2. The assembly of claim 1 in which said means for frictionally engaging includes a ring of friction material.

3. The assembly of claim 2 in which said friction material includes a vinyl compound.

4. An assembly for removably accommodating an image medium, comprising:

a generally cylindrical element;

a transparent sleeve removably disposable over said cylindrical element having an opening at a first end for receiving said element and having an inner diameter slightly larger than the outer diameter of said element for defining a chamber to accommodate the image medium; and means for removably securing said sleeve with said cylindrical element including means, disposed proximate a second end of said sleeve, for fixing said sleeve with said cylindrical element.

5. An assembly for removably accommodating an image medium, comprising:

a generally cylindrical element;

a transparent sleeve removably disposable over said cylindrical element having an opening at a first end for receiving said element and having an inner diameter slightly larger than the outer diameter of said element for defining a chamber to accommodate the image medium;

means for removably securing said sleeve with said cylindrical element; and guide means for axially positioning said transparent sleeve and said cylindrical element relative to each other when said transparent sleeve is disposed over said element, said guide means disposed on said transparent sleeve proximate a second end of said sleeve and including a ring which contacts said cylindrical element.

6. An assembly for removably accommodating an image medium, comprising:

a generally cylindrical element;

a transparent sleeve removably disposable over said cylindrical element having an opening at a first end for receiving said element and having an inner diameter slightly larger than the outer diameter of said element for defining a chamber to accommodate the image medium;

means for removably securing said sleeve with said cylindrical element; and guide means for axially positioning said transparent sleeve and said cylindrical element relative to each other when said transparent sleeve is disposed over said element, said guide means including collar means disposed on said cylindrical element for arresting axial movement of said sleeve.

7. An assembly for removably accommodating an image medium, comprising:

a generally cylindrical element;

a transparent sleeve removably disposable over said cylindrical element having an opening at a first end for receiving said element and having an inner diameter slightly larger than the outer diameter of said element for defining a chamber to accommodate the image medium;

means for removably securing said sleeve with said cylindrical element; and means for engaging said transparent sleeve with said cylindrical element to inhibit rotation of said sleeve relative to said element, said means for engaging including a detent on one of said cylindrical element and said transparent sleeve and at least one recess on the other for receiving said detent.

8. An assembly for removably accommodating an image medium, comprising:

a generally cylindrical element;

a transparent sleeve removably disposable over said cylindrical element having an opening at a first end for receiving said element and having an inner diameter slightly larger than the outer diameter of said element for defining a chamber to accommodate the image medium;

means for removably securing said sleeve with said cylindrical element; and alignment means for laterally positioning said sleeve and said element relative to each other when said sleeve is disposed over said element, said alignment means including a chamfered protrusion on an end of one of said cylindrical element and said transparent sleeve and a recess on an end of the other for mating with said protrusion.

9. An assembly for removably accommodating an image medium in a pen, comprising:

a generally cylindrical pen element;

a transparent sleeve removably disposable over said pen element and having an inner diameter slightly larger than the outer diameter of said pen element for defining a chamber to accommodate the image medium;

guide means for axially positioning said transparent sleeve and said pen element relative to each other when said transparent sleeve is disposed over said pen element; and means for removably securing said sleeve with said pen element, said means for removably securing including means for frictionally engaging said cylindrical element and said transparent sleeve relative to each other.

10. An assembly for removably accommodating an image medium, comprising:

a generally cylindrical element;

a transparent sleeve removably disposable over said cylindrical element, having an opening at a first end for receiving said element, and having an inner diameter slightly larger than the outer diameter of said element for defining a chamber to accommodate the image medium; and means for removably securing said sleeve with said cylindrical element, said means for removably securing including means for fixing said sleeve with said cylindrical element, said means for fixing disposed proximate a second end of said sleeve and including shaft means and means for releasably receiving said shaft means.

11. The assembly of claim 10 in which said shaft means is extendable through a hole in said means for receiving.

12. The assembly of claim 11 in which said shaft means includes at least one dog proximate the end extendable through said hole.

13. The assembly of claim 12 in which said hole is shaped so that in at least one orientation it admits said dog.

14. The assembly of claim 13 in which said means for receiving includes a camming surface and said dog interacts with said camming surface to forcibly engage said transparent sleeve against and cylindrical element.

15. The assembly of claim 14 in which said camming surface includes a land for said dog with a slope on one side of said land and a stop on the other side.

16. The assembly of claim 14 in which said shaft means includes a grip on its end opposite the end extendable through said hole in said means for receiving.

17. The assembly of claim 16 in which said grip is knurled.

18. The assembly of claim 14 in which said transparent sleeve includes a ring, disposed proximate said second end, for engaging said cylindrical element.

19. The assembly of claim 10 in which said means for receiving is mounted within said cylindrical element.

20. An assembly for removably accommodating an image medium, comprising:

a generally cylindrical element;

a transparent sleeve removably disposable over said cylindrical element, having an opening at a first end for receiving said element, and having an inner diameter slightly larger than the outer diameter of said element for defining a chamber to accommodate the image medium;

means for removably securing said sleeve with said cylindrical element; and guide means, including collar means disposed on said cylindrical element for arresting axial movement of said first end of said transparent sleeve, for axially positioning said transparent sleeve and said cylindrical element relative to each other when said transparent sleeve is disposed over said element.

* * * * *